US006944955B2

(12) United States Patent
Skrivan et al.

(10) Patent No.: US 6,944,955 B2
(45) Date of Patent: Sep. 20, 2005

(54) COMPETITION/LEASHLESS ICE AXE WITH ADJUSTABLE GRIP

(75) Inventors: Joseph Skrivan, Draper, UT (US); David S. Sanders, Salt Lake City, UT (US)

(73) Assignee: Black Diamond Equipment, Ltd. Inc., Salt Lake City, UT (US)

( * ) Notice: Subject to any disclaimer, the term of this patent is extended or adjusted under 35 U.S.C. 154(b) by 115 days.

(21) Appl. No.: 10/635,102

(22) Filed: Aug. 6, 2003

(65) Prior Publication Data

US 2005/0028387 A1 Feb. 10, 2005

Related U.S. Application Data

(60) Provisional application No. 60/401,987, filed on Aug. 7, 2002.

(51) Int. Cl.[7] ..... B26B 23/00

(52) U.S. Cl. ..... 30/308.1; 7/145; D8/76

(58) Field of Search ..... 30/308.1, 526; 7/145; D8/76; 16/429

(56) References Cited

U.S. PATENT DOCUMENTS

| | | | | | |
|---|---|---|---|---|---|
| 29,192 | A | * | 7/1860 | Porter | 30/308.1 |
| 263,104 | A | | 8/1882 | Bickel | |
| 511,768 | A | * | 1/1894 | French | 30/308.1 |
| 802,937 | A | | 10/1905 | McCune et al. | |
| 982,564 | A | | 1/1911 | Baker | |
| 1,054,823 | A | | 3/1913 | Burks | |
| 1,164,092 | A | * | 12/1915 | Higgs | 30/308.1 |
| 1,177,472 | A | | 3/1916 | Bartlett | |
| 1,259,161 | A | | 3/1918 | Suer | |
| 1,309,180 | A | | 7/1919 | Carr | |
| 1,330,213 | A | * | 2/1920 | Munzer | 30/308.1 |
| 1,388,872 | A | | 8/1921 | McElhaney | |
| D124,300 | S | | 12/1940 | Morris | D7/650 |
| 2,738,815 | A | * | 3/1956 | Hoeldtke | 30/308.1 |
| 2,798,292 | A | | 7/1957 | Bishaf | |
| 2,804,109 | A | | 8/1957 | Fatica | |
| 2,879,591 | A | * | 3/1959 | Bennett | 30/125 |
| 3,114,973 | A | | 12/1963 | Kennedy | |
| D203,575 | S | | 1/1966 | Dobbs | D8/76 |
| 3,252,489 | A | | 5/1966 | Huston et al. | |
| 3,559,340 | A | | 2/1971 | Good | |
| 3,712,659 | A | | 1/1973 | Kneissl | |
| 3,735,434 | A | | 5/1973 | Penberthy | |
| 4,023,606 | A | | 5/1977 | Kneissl | |
| 5,210,925 | A | | 5/1993 | Morgulis | |
| 5,347,718 | A | | 9/1994 | Turner | 30/122 |
| 5,425,176 | A | | 6/1995 | Brainerd et al. | 30/308.1 |
| 5,937,466 | A | | 8/1999 | Brainerd et al. | 7/145 |
| 5,996,235 | A | | 12/1999 | Brainerd | 30/308.1 |
| 6,073,307 | A | * | 6/2000 | Santos et al. | 16/429 |

FOREIGN PATENT DOCUMENTS

| | | | |
|---|---|---|---|
| DE | 44 17 759 A1 | * | 12/1994 |
| EP | 1 388 353 A1 | * | 2/2004 |
| FR | 900664 | * | 7/1945 |
| GB | 5494 | | of 1907 |
| GB | 9987 | | of 1911 |

* cited by examiner

*Primary Examiner*—Hwei-Siu Payer
(74) *Attorney, Agent, or Firm*—Thorpe North & Western

(57) ABSTRACT

An ice axe device and method has an adjustable grip. The ice axe includes an elongated shaft with opposite proximal and distal ends. A pick is disposed at the distal end of the elongated shaft, and a grip is disposed at the proximal end of the elongated shaft. A pommel is adjustably securable to a proximal end of the grip, and is movable towards and away from the grip to respectively shorten and lengthen a length of the grip. At least one spacer can be selectively disposable on the grip to selectively shorten and lengthen the length of the grip

16 Claims, 4 Drawing Sheets

COMPETITION/LEASHLESS ICE AXE WITH ADJUSTABLE GRIP

This application claims the benefit of U.S. Provisional Patent Application No. 60/401,987, filed Aug. 7, 2002, which is herein incorporated by reference.

BACKGROUND OF THE INVENTION

1. Field of the Invention

The present invention relates generally to a competition and/or leashless type ice axe for ice climbing, Alpining, and the like. More particularly, the present invention relates to an adjustable grip for such an ice axe.

2. Related Art

Ice and mountain climbing entail the extensive use of ice axes for ascending and descending ice, snow and rock, for positioning and driving anchor screws, bolts and pins, and for clearing obstacles. In ice climbing, the strength and safety of given placement depends largely upon getting the tip of the pick portion of the ice axe securely driven into the ice. Bulges in the ice or rock, or other obstacles, can inhibit driving the pick tip securely into the ice.

Attempts to enable driving the pick of an ice axe farther into ice or rock than would normally be possible, have resulted in equipment designers putting an exaggerated bend in the ice axe handle near the pick. That is, some ice axe handles have an exaggerated bend in the direction away from that of the pick, ostensibly to accommodate bulges or other obstacles which might otherwise interfere with the handle and prevent the pick from being driven in sufficiently far.

Ice axes typically have a hammer head opposite the pick on the axe's working end. This hammer is designed primarily for driving bolts or pins. On conventional ice axes, the hammer portion of the axe head is shorter than the pick relative to the center of the axe handle, and typically has a bottom surface that is flat.

In addition, competition or leashless type ice axes include a double grip or handle with a primary or off-set handle disposed adjacent and below a secondary or shaft handle. The primary handle is off-set and oriented at an angle inwardly with respect to the secondary handle. The user or climber uses the primary handle while climbing until or unless it is necessary to grip the secondary handle with the second hand. One disadvantage with such ice axes is that the primary handles often are only one size, and fail to properly position the user's hand with respect to the handles. During use, the climber swings the axe back and forth, with a transition point between the primary and secondary handles pivoting in the climber's hand. One complaint is that the primary handle positions the climber's hand too low on the primary handle, resisting the pivot action of the axe during use.

SUMMARY OF THE INVENTION

It has been recognized that it would be advantageous to develop an improved ice axe that is safe and easy to use. In addition, it has been recognized that it would be advantageous to develop an ice axe that pivots correctly in the climber's hand, despite the size of the user's hand.

The invention provides an ice axe device with an adjustable grip or handle to properly fit the size of the user's hand. The ice axe device includes an elongated shaft with opposite proximal and distal ends. A pick is disposed at the distal end of the elongated shaft, and a grip is disposed at the proximal end of the elongated shaft. A pommel is adjustably securable to a proximal end of the grip, and is movable towards and away from the grip to respectively shorten and lengthen a length of the grip.

In accordance with a more detailed aspect of the present invention, the device can include at least one spacer selectively disposable on the grip to selectively shorten and lengthen the length of the grip.

The invention also provides a method for adjusting a length of a grip of an ice axe. An ice axe is provided having a grip and a pick disposed on respective proximal and distal ends of an elongated shank. A pommel is adjustably securable to a proximal end of the grip, and is moved towards or away from the grip to respectively shorten or lengthen a length of the primary grip.

In accordance with a more detailed aspect of the present invention, the method can include removing or adding at least one spacer on the grip, and securing the pommel to the grip.

Additional features and advantages of the invention will be apparent from the detailed description which follows, taken in conjunction with the accompanying drawings, which together illustrate, by way of example, features of the invention.

DETAILED DESCRIPTION

Figure 1:
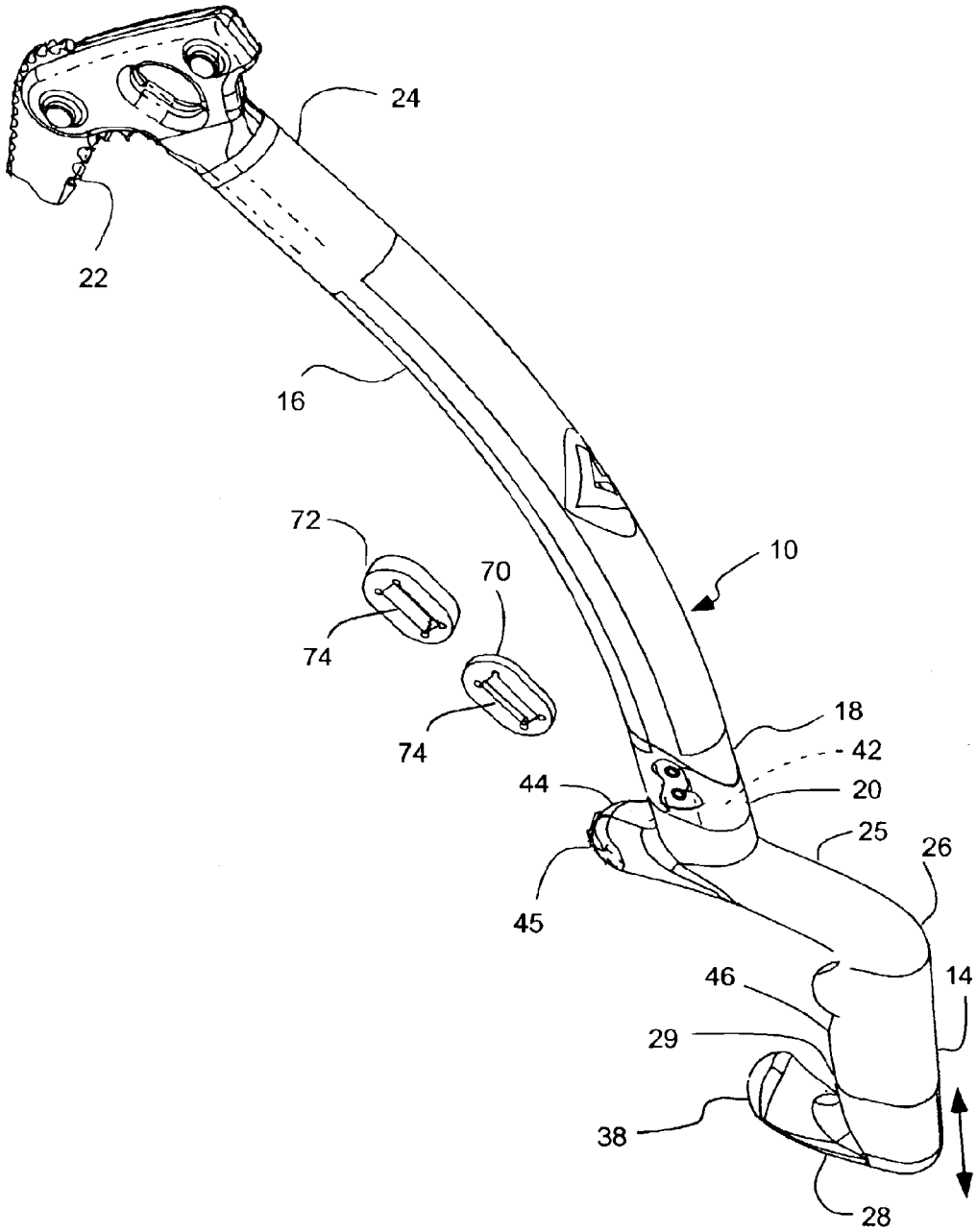
FIG. 1 is a perspective view of a competition or leashless ice axe with an adjustable handle or grip in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1 an ice axe device, indicated generally at 10, with an adjustable handle or grip 14 in accordance with the present invention is shown for accommodating the size of a climber's hand during ice climbing and the like. Ice climbing, Alpining, and the like are examples of fields that can benefit from the use of such an ice axe. The ice axe device 10 can be a competition or leashless type ice axe.

The ice axe device 10 can include an elongated shaft 16 with a secondary handle or grip 18 disposed on a proximal end 20, and an axe head with a pick 22 or the like disposed on a distal end 24. The axe head or pick 22 can have various different configurations, as understood by those skilled in the art. The adjustable grip 14 can be a primary or offset grip, and can be disposed on the proximal end 20 of the shaft 16, below the secondary grip 18, or on a proximal end of the secondary grip 18.

The user or climber can grip the primary or offset grip 14 to swing the pick 22 of the ice axe 10 into the ice, etc. The primary grip 14 can be spaced behind and below the secondary grip 18. In addition, the offset grip 14 can have a different angular orientation with respect to the secondary grip 18, and can form an acute angle therewith. Thus, the primary and secondary grips 14 and 18 are off-set from one another. An attachment arm 25 can connect the primary grip 14 to the ice axe 10 or secondary grip 18. The attachment arm can extend rearwardly from the proximal end of the ice axe or secondary grip to a distal end of the primary grip 14.

In use, the climber holds the ice axe 10 with the primary or off-set grip 14, and swings the axe into the ice. In competition climbing, the climber rapidly swings the ice axe back and forth, with the ice axe pivoting back and forth in the climber's hand. During the swing or pivot of the ice axe, it is desirable for a transition portion 26 of the primary grip 14 to pivot in the climber's hand for maximum force and comfort. The transition portion 26 can be formed between the arm 25 and the primary grip 14, and can be arcuate or angled. The transition portion 26 can form a bend that fits into the palm of the climber's hand.

As described above, to properly use the ice axe 10, the primary or off-set grip 14 should be positioned so that the transition portion 26 can pivot in the user's hand. One complaint with typical ice axes is the difficulty in properly positioning the grip. For example, typical grips are often provided in a single size. Thus, many climbers have difficulty obtaining the proper grip or position. For example, a climber with smaller hands can have their hand slip downward to the bottom of the grip, so that there is a gap between the top of their hand, and the attachment arm, and so that the transition portion is positioned above their hand, rather than at or in their hand.

Figure 4:
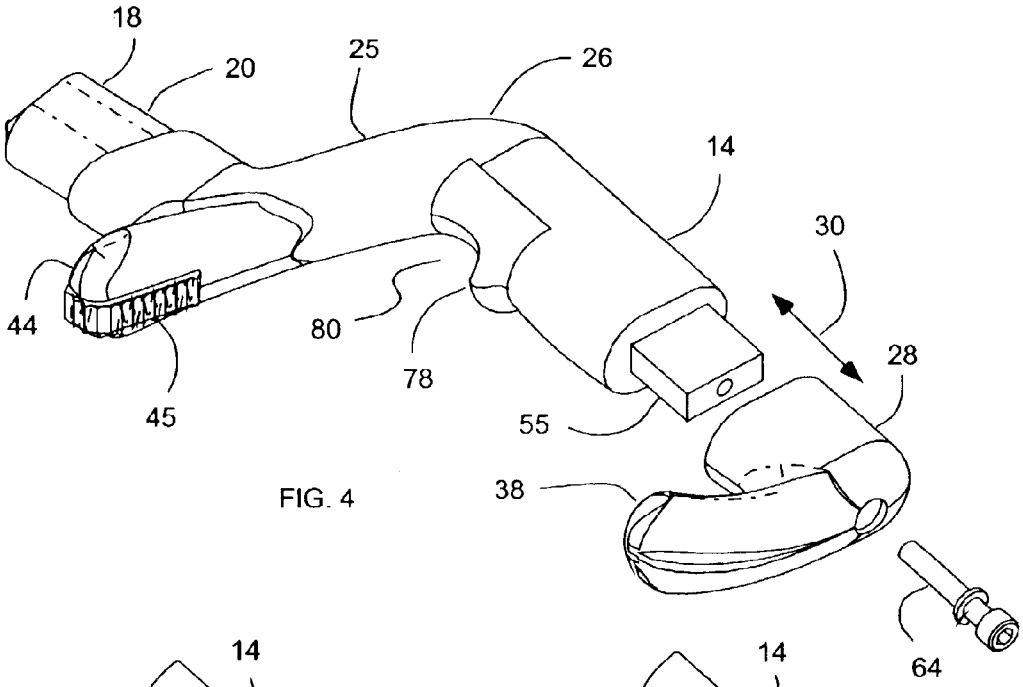
FIG. 4 is a partial exploded view of the adjustable grip of FIG. 1.

The primary or off-set grip 14 of the of the ice axe 10 advantageously is adjustable, or is an adjustable grip. The adjustable grip 14 can include a pommel or tip 28 that can be adjustably securable to a proximal end 29 of the primary grip 14. The pommel 28 can be movable towards and away from the primary grip, indicated by arrow 30 (FIG. 4), to respectively shorten and lengthen a length of the primary grip 14. The pommel 28 can be selectively positioned along the length of the primary grip 14, indicated by arrow 30 (FIG. 4). Thus, the length of the primary grip 14 can be adjusted to suit the size of the climber's hand. The pommel or tip 28 can be positioned so that the primary grip has a length substantially the width of the climber's hand. Thus, the lower surface of the climber's hand can be positioned against the pommel or pommel 28, while the upper surface of the climber's hand can be positioned against the attachment arm 25. As the climber hangs from the ice axe 10, the pommel or tip 28 keeps the climber's hand against a top of the primary grip 14. Thus, the climber can swing the axe with the transition portion 26 properly positioned for maximum swing and comfort.

The pommel 28 can form a knob, tip or end that is larger or wider than the grip, or that extends laterally beyond a cross-sectional or lateral perimeter of the grip, to retain the climber's hand on the grip. The pommel 28 can include a protrusion 38 that extends transverse or lateral to a longitude of the grip. The protrusion 38 can have a concave indentation formed therein to receive the lower portion or outer finger of the climber's hand. In addition, the protrusion 38 can be flared, or can widen as it extends outwardly from the grip.

Figure 5:
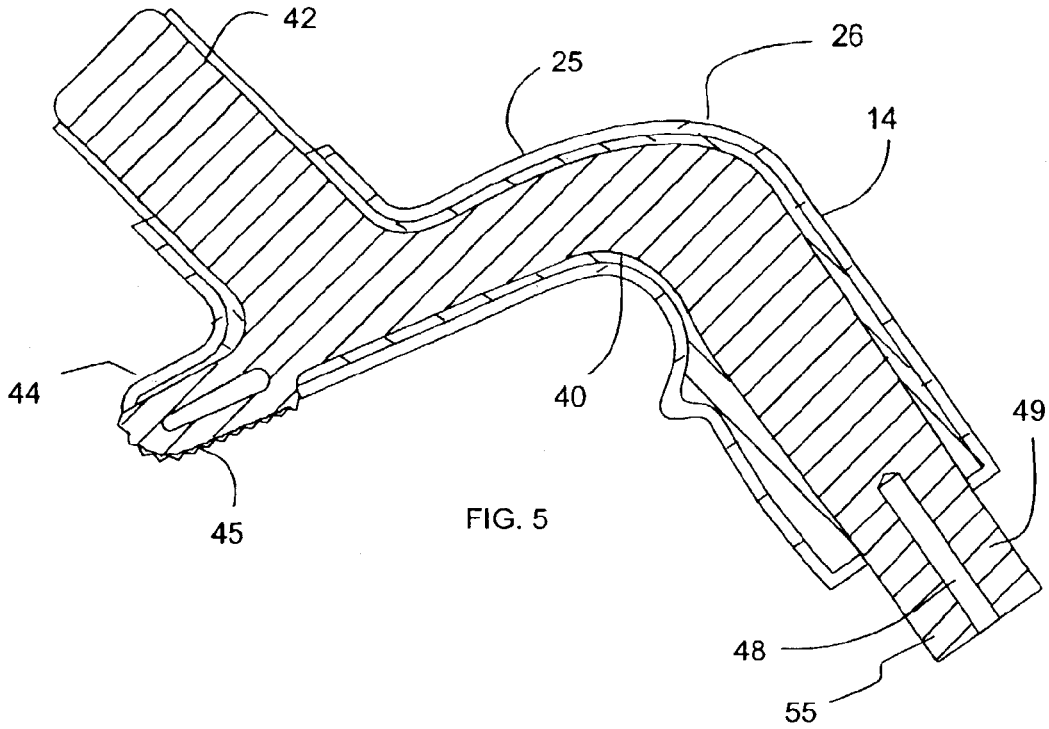
FIG. 5 is a cross-sectional side view of the adjustable grip of FIG. 1.
Figure 8:
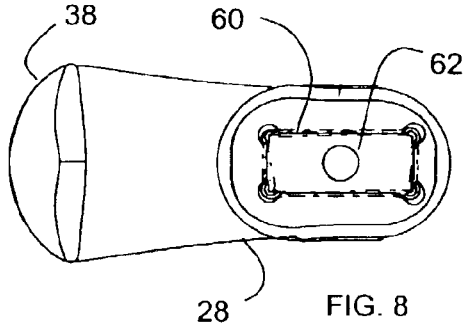
FIG. 8 is a top view of the pommel of FIG. 6.
Figure 6:
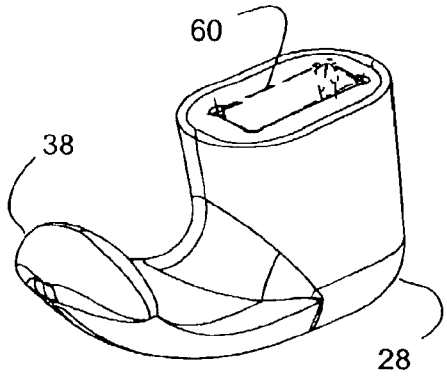
FIG. 6 is a perspective view of a pommel of the adjustable grip of FIG. 1.
Figure 10:
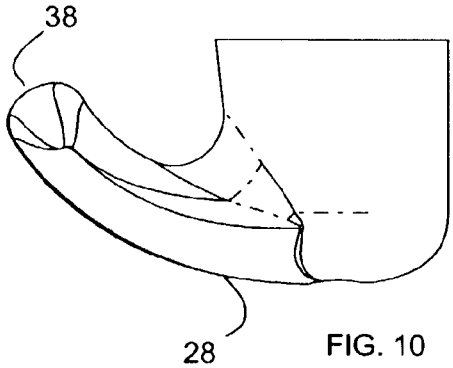
FIG. 10 is a side view of the pommel of FIG. 6.
Figure 7:
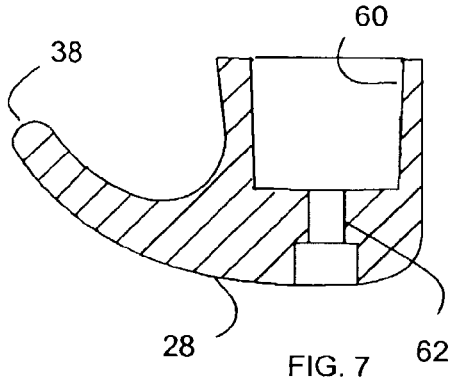
FIG. 7 is a cross-sectional side view of the pommel of FIG. 6.
Figure 9:
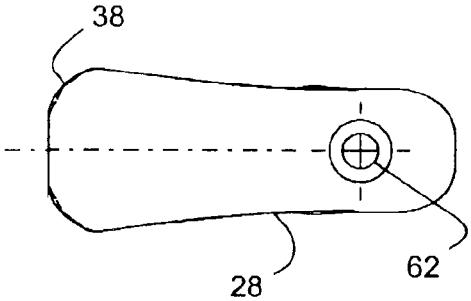
FIG. 9 is a bottom view of the pommel of FIG. 6.
Figure 11:
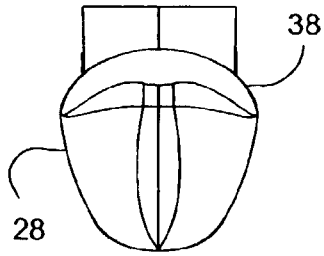
FIG. 11 is an end view of the pommel of FIG. 6.

Referring to FIG. 5, the primary grip 14 can include an internal support or frame 40. The frame 40 can be formed of a strong material, such as metal, to support the climber's weight hanging from the ice axe, and the impact of the ice axe being driven into the ice. The frame 40 can be formed from sheet material cut or stamped to the desired shape and size. The frame 40 can include an insert section 42 that can be inserted into an end of the shaft 16. In addition, the frame 40 can include a projection 44 adjacent the insert section 42 to form a secondary pommel 45 for the secondary grip 18 (FIG. 1). The frame 40 can be shaped to form the attachment arm 25, the transition portion 26, and the primary grip 14. The frame 40 can be wholly or partially surrounded by grip portions 46 (FIG. 1), particularly on the sides of the frame 40, to provide a wider and more comfortable grip. The grip portions 46 can be made of a firm and/or high friction material. A bore 48 can be formed at a proximal end 49 of the frame to receive a fastener. For example, the bore 48 can be threaded to receive a bolt, as described below.

The secondary pommel 45 can extend laterally outwardly from the secondary grip 18. The secondary pommel 45 can extend forwardly, in the direction of the axe head, and can have a serrated edge facing forwardly and/or downwardly to act as a secondary engagement or gripping surface along with the axe head.

Referring to FIGS. 4 and 6–11, the proximal end 49 of the frame 40 or of the grip 14 forms a grip shaft or a protrusion 55 of the grip. The pommel or tip 28 can include a cavity 60 to receive the protrusion 55 of the grip 14. The protrusion 55 and the cavity 60 can have matching, non-circular cross-sectional shapes to maintain the pommel 28 aligned with the grip 14. A bore 62 can be formed in a bottom of the pommel or pommel 28 to receive a fastener 64 (FIG. 4), such as a screw or bolt, to secure the pommel or tip 28 to the protrusion 55, and thus to the frame 40 and grip 14. The fastener 64 can extend through the pommel 28 and into the threaded bore 48 of the protrusion 55. The bolt can be counter-sunk in the pommel. The screw or bolt is one example of means for securing the protrusion 55 of the grip 14 in the cavity 60 of the pommel 28. Other means can be used, including for example, set screws, etc.

Figure 2:
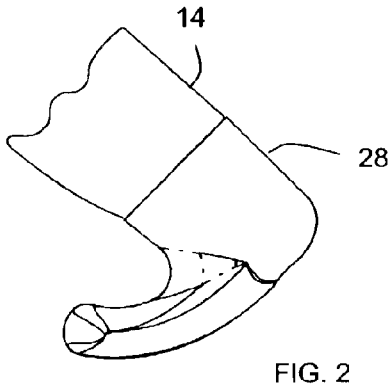
FIG. 2 is a partial side view of the adjustable grip of FIG. 1 shown in a shorter configuration.

Referring to FIGS. 1–4, one or more spacers 70 and 72 can be selectively disposable on the primary grip 14 to selectively shorten and lengthen the length of the primary grip. The spacers 70 and 72 can be disposed on the protrusion 55 of the grip, between the pommel 28 and the frame 40 or grip 14. The spacers 70 and 72 can have an aperture or bore 74 that extends through the spacer and receives the protrusion 55 of the grip. It will be appreciated that adding spacers 70 and 72 to the grip 14 lengthens the grip (as shown in FIGS. 3*a–c*), while removing spacers 70 and 72 shortens or narrows the grip 14 (as shown in FIG. 2). Thus, a climber can add or remove spacers 70 and 72 to lengthen or shorten the grip 14 to accommodate the size of their hand, and properly position their hand. For example, the grip can have a length sized for a smaller hand, and provided with spacers so that climbers with larger hands can lengthen the grip. In addition, the spacers 70 and 72 can fill any gap between the pommel 28 and grip 14, providing a smooth continuous grip surface. Thus, the spacers can have an outer size that matches an outer size of the grip, and can have an outer surface that is flush with an outer surface of the grip.

Figure 3A:
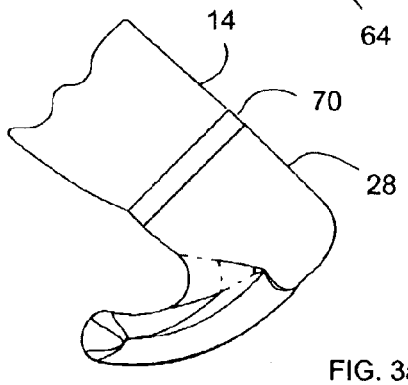
FIGS. 3*a–c* are partial side views of the adjustable grip of FIG. 1 shown in longer configurations.
Figure 3B:
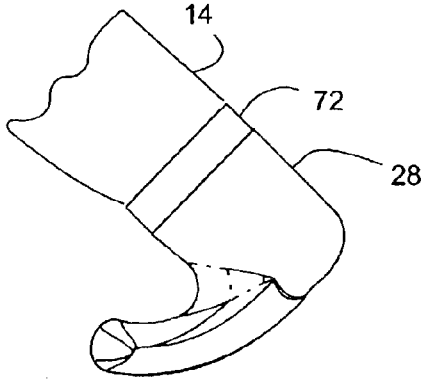
Figure 3C:
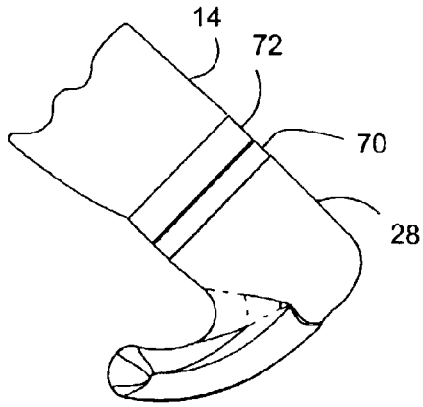

The ice axe 10 can be provided with a set of spacers, or a plurality of spacers of different sizes or widths. Thus, a particular spacer with a particular width can be inserted in the grip to achieve the desired size. For example, one spacer 70 can have a width of ¼ inch, and another spacer 72 can have a width of ⅛ inch. Thus, the length of the grip can be adjusted up to ⅜ inches (with both spacers) in ⅛ inch increments (⅛ inch, ¼ inch, and ⅜ inch with both the ⅛ inch and ¼ inch spacer). For example, the grip can be lengthened ⅛ inch with the ⅛ inch spacer 70 (FIG. 3*a*); lengthened ¼ inch with the ¼ inch spacer 72 (FIG. 3*b*); or lengthened ⅜ inches with both spacers 70 and 72 (FIG. 3*c*).

In use, the pommel 28 is adjustably securable to a proximal end of the grip 14, and moved towards or away from the primary grip 14 to respectively shorten or lengthen a length of the grip. The pommel 28 can be removed from the grip 14 by removing the fastener 64. Spacers 70 and/or 72 can be added or removed to lengthen or shorten the length of the grip. The pommel can be re-secured to the grip with the fastener.

Referring to FIG. 4, the primary grip 14 can include a protrusion 78 at an upper end and extending forwardly to form a space 80 at the top of the grip to receive the climber's index finger. Thus, the climber's index finger can form a pivot point for swinging the ice axe. The protrusion 78 and space 80 form a partial pivot surface around the climber's index finger. In addition, the protrusion 78 forms additional gripping to resist the climber's hand from sliding down the grip.

Various other aspects of the ice axe device are described in U.S. Pat. Nos. 5,425,176; 5,768,727; 5,937,466; and 5,996,235, which are herein incorporated by reference.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. An ice axe device, comprising:

a) an elongated shaft with opposite proximal and distal ends;

b) a pick, disposed at the distal end of the elongated shaft;

c) a grip, disposed at the proximal end of the elongated shaft;

d) a pommel, adjustably securable to a proximal end of the grip, movable towards and away from the grip to respectively shorten and lengthen a length of the grip e) at least one spacer, selectively disposable on the grip, to selectively lengthen the length of the grip:

f) a protrusion, formed on the proximal end of the grip, to receive the at least one spacer thereon; and g) a bore, extending through the at least one spacer to receive the protrusion of the grip therethrough.

2. A device in accordance with claim 1, wherein the at least one spacer is selectively disposable between the grip and the pommel.

3. A device in accordance with claim 1, wherein the grip is a primary grip, and further comprising:

a secondary grip, disposed at the proximal end of the elongated shaft between the proximal end of the shaft and the primary grip; and the primary grip being off-set from the secondary grip.

4. A device in accordance with claim 3, further comprising:

an attachment arm, extending rearwardly from the proximal end of the secondary grip to a distal end of the primary grip.

5. A device in accordance with claim 1, further comprising:

a cavity, formed in the pommel;

the protrusion, extendable into the cavity of the pommel; and means for securing the protrusion in the cavity.

6. An ice axe device, comprising:

a) an elongated shaft with opposite proximal and distal ends;

b) a pick, disposed at the distal end of the elongated shaft;

c) a secondary grip, disposed at the proximal end of the elongated shaft;

d) a primary grip, disposed at a proximal end of the secondary grip; and e) a pommel, adjustably securable to a proximal end of the primary grip, movable towards and away from the primary grip to respectively shorten and lengthen a length of the primary grip, f) the secondary grip, being offset from the primary grip.

7. A device in accordance with claim 6, further comprising:

at least one spacer, selectively disposable on the primary grip, to selectively lengthen the length of the primary grip.

8. A device in accordance with claim 7, wherein the at least one spacer is selectively disposable between the primary grip and the pommel.

9. A device in accordance with claim 7, further comprising:

a protrusion, formed on the proximal end of the primary grip, to receive the at least one spacer thereon; and a bore, extending through the at least one spacer to receive the protrusion of the primary grip therethrough.

10. A device in accordance with claim 6, further comprising:

a cavity, formed in the pommel;

a protrusion, formed on the proximal end of the primary grip, and extendable into the cavity of the pommel; and means for securing the protrusion in the cavity.

11. A device in accordance with claim 6, further comprising:

an attachment arm, extending rearwardly from the proximal end of the secondary grip to a distal end of the primary grip.

12. An ice axe device, comprising:

a) an elongated shaft with opposite proximal and distal ends;

b) a pick, disposed at the distal end of the elongated shaft;

c) a grip, disposed at the proximal end of the elongated shaft;

d) a pommel, adjustably securable to a proximal end of the grip, movable towards and away from the grip to respectively shorten and lengthen a length of the grip;

e) a cavity, formed in the pommel;

f) a protrusion, formed on the proximal end of the grip and extendable into the cavity of the pommel; and g) means for securing the protrusion in the cavity.

13. A device in accordance with claim 12, further comprising:

at least one spacer, selectively disposable on the grip, to selectively lengthen the length of the primary grip.

14. A device in accordance with claim 13, wherein the at least one spacer is selectively disposable between the primary grip and the pommel.

15. A device in accordance with claim 12, wherein the grip is a primary grip, and further comprising:

a secondary grip, disposed at the proximal end of the elongated shaft between the proximal end of the shaft and the primary grip; and the primary grip being off-set from the secondary grip.

16. A device in accordance with claim 15, further comprising:

an attachment arm, extending rearwardly from the proximal end of the secondary grip to a distal end of the primary grip.

* * * * *